US008058862B2

(12) United States Patent
Ikeda et al.

(10) Patent No.: US 8,058,862 B2
(45) Date of Patent: Nov. 15, 2011

(54) REFERENCE VOLTAGE GENERATION CIRCUIT

(75) Inventors: Takeshi Ikeda, Tokyo (JP); Hiroshi Miyagi, Yokohama (JP)

(73) Assignee: Ricoh Co., Ltd., Tokyo (JP)

( * ) Notice: Subject to any disclaimer, the term of this patent is extended or adjusted under 35 U.S.C. 154(b) by 294 days.

(21) Appl. No.: 12/518,050

(22) PCT Filed: Nov. 30, 2007

(86) PCT No.: PCT/JP2007/073624
§ 371 (c)(1),
(2), (4) Date: Jun. 5, 2009

(87) PCT Pub. No.: WO2008/069291
PCT Pub. Date: Jun. 12, 2008

(65) Prior Publication Data

US 2010/0315060 A1 Dec. 16, 2010

(30) Foreign Application Priority Data

Dec. 8, 2006 (JP) ..... 2006-331391

(51) Int. Cl.
*G05F 3/16* (2006.01)

(52) U.S. Cl. ..... 323/314

(58) Field of Classification Search ..... 323/274, 323/281, 282, 284, 312, 314
See application file for complete search history.

(56) References Cited

U.S. PATENT DOCUMENTS

| | | | | |
|---|---|---|---|---|
| 6,650,524 | B2 * | 11/2003 | Koyasu | 361/93.8 |
| 7,812,685 | B2 * | 10/2010 | Ishiguro | 333/17.1 |
| 7,855,537 | B2 * | 12/2010 | Aizawa | 323/277 |
| 7,859,235 | B2 * | 12/2010 | Yamashita | 323/274 |
| 7,936,158 | B2 * | 5/2011 | Noda | 323/282 |
| 2002/0149350 | A1 * | 10/2002 | Koyasu | 323/274 |
| 2004/0095986 | A1 * | 5/2004 | Tsuchiya | 374/163 |

FOREIGN PATENT DOCUMENTS

| | | |
|---|---|---|
| JP | 06-059751 | 3/1994 |
| JP | 06-214665 | 8/1994 |
| JP | 2004-110750 | 4/2004 |

OTHER PUBLICATIONS

International Search Report issued in related International Application Serial No. PCT/JP2007/073624 on Feb. 26, 2008.

* cited by examiner

*Primary Examiner* — Adolf Berhane
(74) *Attorney, Agent, or Firm* — Connolly Bove Lodge & Hutz LLP

(57) ABSTRACT

A basic structure of a reference voltage generation circuit is formed by a buffer amplifier (21) and a resistive element (22) without using a band gap regulator. Thus, an influence of a noise of the band gap regulator as in the conventional art is eliminated. There are provided comparators (23) and (24) for comparing an input voltage of the buffer amplifier (21) with an output voltage of a band gap regulator (10), and a control circuit (25) for variably controlling a resistance value of the resistive element (22) in response to comparison signals. Consequently, even if an output voltage ($V_{out}$) of the buffer amplifier (21) temporarily fluctuates with a change in a source voltage ($V_{DD}$), it returns into a desirable voltage range and converges through a variable control of the resistance value.

6 Claims, 5 Drawing Sheets

REFERENCE VOLTAGE GENERATION CIRCUIT

CROSS-REFERENCE TO RELATED APPLICATIONS

This application is a 35 U.S.C. 371 Application of International Application Serial No. PCT/JP2007/073624, filed Nov. 30, 2007, claiming priority from Japanese Patent Application No. 2006-331391, filed Dec. 8, 2006, the contents of which are incorporated herein in their entireties.

TECHNICAL FIELD

The present invention relates to a reference voltage generation circuit for generating a reference voltage to be widely utilized in various analog circuits.

BACKGROUND ART

In general, a reference voltage is widely used in various analog circuits. A circuit for generating the reference voltage includes a band gap regulator for suppressing a fluctuation in an output voltage due to a change in a source voltage (for example, see Patent Document 1).

Patent Document 1: Japanese Laid-Open Patent Publication No. 6-309052

FIG. 1 is a diagram showing a structure of a conventional reference voltage generation circuit utilizing a band gap regulator. A band gap regulator 10 shown in FIG. 1 has a current determination circuit 11 including a positive feedback circuit, a current mirror circuit 12, and a voltage generation circuit 13 connected through the current mirror circuit 12 to generate a voltage upon receipt of a current determined by the current determination circuit 11.

The current determination circuit 11 is constituted by PNP transistors Q1 and Q2, Nch transistors M1 and M2, Pch transistors M3 and M4, and a resistor R1. The PNP transistor Q1 has a collector and a base connected to a ground and has an emitter connected to a source of the Nch transistor M1. A gate of the Nch transistor M1 is diode connected to its own drain and is connected to a gate of the Nch transistor M2.

The drain of the Nch transistor M1 is also connected to a drain of the Pch transistor M3. On the other hand, the Nch transistor M2 has a drain connected to that of the Pch transistor M4 and has a source connected to an emitter of the PNP transistor Q2 through the resistor R1. A collector and a base of the PNP transistor Q2 are connected to grounds. A gate of the Pch transistor M4 is diode connected to its own drain and is connected to a gate of the Pch transistor M3.

The current mirror circuit 12 is constituted by connecting the gates of the Pch transistors M3, M4 and M5 in common and diode connecting the gate of the Pch transistor M4 to its own drain. The Pch transistors M3, M4 and M5 have sources connected to a power supply $V_{OD}$.

The voltage generation circuit 13 is constituted by a PNP transistor Q3, the Pch transistor M5 and a resistor R2. The Pch transistor M5 has a drain connected to an emitter of the PNP transistor Q3 through the resistor R2. The PNP transistor Q3 has a collector and a base connected to grounds.

An operational amplifier 14 has a positive terminal connected between the drain of the Pch transistor M5 and the resistor R2. An output terminal $V_{out}$ having a reference voltage is provided on an output side of the operational amplifier 14 and voltage division resistors R3 and R4 are provided between the output terminal $V_{out}$ and a ground, and a divided output voltage is negative fed back to a negative terminal of the operational amplifier 14.

In the band gap regulator 10 described above, a positive feedback is applied to the Nch transistor M1 and M2 portions, and impedances of the transistors Q1 and Q2 and the resistors R1 and R2 act as noises to influence an output signal when they are positive fed back. A noise voltage (a thermal noise) appearing in the resistors R1 and R2 is amplified by the positive feedback to have a great value. For this reason, an output impedance of the band gap regulator 10 has a very great value and an output current thereof has a small value.

In order to amplify the small output current, the operational amplifier 14 is provided on an output side of the band gap regulator 10. In the operational amplifier 14, an input conversion noise voltage is generated. A noise on the output side of the operational amplifier 14 has a value obtained by multiplying the input conversion noise voltage by an amplification factor of the operational amplifier 14. When the amplification factor is great, the output noise (the thermal noise) of the operational amplifier 14 also has such a great value as not to be disregarded.

DISCLOSURE OF THE INVENTION

The great noises made in the band gap regulator 10 and the operational amplifier 14 carry out wraparound into the circuit of the band gap regulator 10, resulting in a deterioration in S/N. As a method of solving the problem, it can be proposed to provide a capacitor C having a large capacity between the power supply $V_{DD}$ of the band gap regulator 10 and a ground as shown in FIG. 2. However, there is a drawback that the capacitor C having a large capacity is not suitable for an integration.

In order to reduce the noise without using the capacitor C having a large capacity, it is possible to propose a countermeasure, for example, nonuse of the band gap regulator acting as a noise source, a decrease in the amplification factor of the operational amplifier 14 (nonuse of the voltage division resistors R3 and R4 to be connected to the output side of the operational amplifier 14) or the like. FIG. 3 is a diagram showing an example of a structure of a reference voltage generation circuit in the case in which the countermeasure is taken. When resistance values of voltage division resistors Ra and Rb provided on the input side of the operational amplifier 14 are decreased, it is possible to enhance a noise reducing effect.

However, in the case in which the reference voltage generation circuit is constituted as shown in FIG. 3, the band gap regulator 10 is not used. For this reason, there is a fundamental problem in that an output voltage greatly fluctuates with a change in a source voltage and a stable reference voltage cannot be generated. More specifically, when the source voltage is represented by $V_{DD}$, a voltage to be input to the positive terminal of the operational amplifier 14 is represented by $V_R$, the amplification factor of the operational amplifier 14 is represented by A and the output voltage is represented by $V_{out}$, the following formula is obtained.

$$V_{out}=A\cdot V_R=Rb/(Ra+Rb)\cdot V_{DD}\ (A=1)$$

Consequently, the output voltage $V_{out}$ is directly affected by a fluctuation in the source voltage $V_{DD}$.

In order to solve the problem, it is an object of the present invention to provide a reference voltage generation circuit which can easily be integrated and lessens an influence of a noise, and also reduces a fluctuation in an output voltage due to a change in a source voltage.

In order to attain the object, in the present invention, a reference voltage generation circuit includes, as a basic structure, a buffer amplifier to be driven by a source voltage and a resistive element for determining an input voltage of the buffer amplifier. As a structure for stabilizing an output voltage of the buffer amplifier, there are provided a band gap regulator, a comparator for comparing the input or output voltage of the buffer amplifier or a voltage generated by a dummy resistive element imitating the resistive element with an output voltage of the band gap regulator, and a control circuit for variably controlling a resistance value of the resistive element in response to a comparison signal output from the comparator.

According to the present invention having the structure described above, the band gap regulator is not included as the basic structure of the reference voltage generation circuit Therefore, it is possible to eliminate a drawback that a noise made in the band gap regulator carries out wraparound into a circuit of the basic structure, resulting in a deterioration in S/N. In the present invention, since an operational amplifier is not used but a buffer amplifier having an amplification factor of one is used, it is also possible to reduce an output noise thereof. Consequently, it is possible to effectively reduce an influence of the noise without using a capacitor having a large capacity which inhibits an integration.

Furthermore, according to the present invention, the input voltage or the output voltage of the buffer amplifier (that is, a reference voltage output from the reference voltage generation circuit) or a voltage (a voltage generated by the dummy resistive element) which is almost equivalent thereto is monitored by the comparator and the resistance value of the resistive element is variably controlled in such a manner that the output voltage of the buffer amplifier is stabilized within a desirable voltage range. Therefore, even if the output voltage of the buffer amplifier temporarily gets out of the desirable voltage range with a fluctuation in a source voltage, the output voltage of the buffer amplifier returns into the desirable voltage range and converges through the variable control of the resistance value. Consequently, it is possible to maintain the output voltage of the reference voltage generation circuit to be almost constant even if the source voltage fluctuates.

BEST MODE FOR CARRYING OUT THE INVENTION

Figure 4:
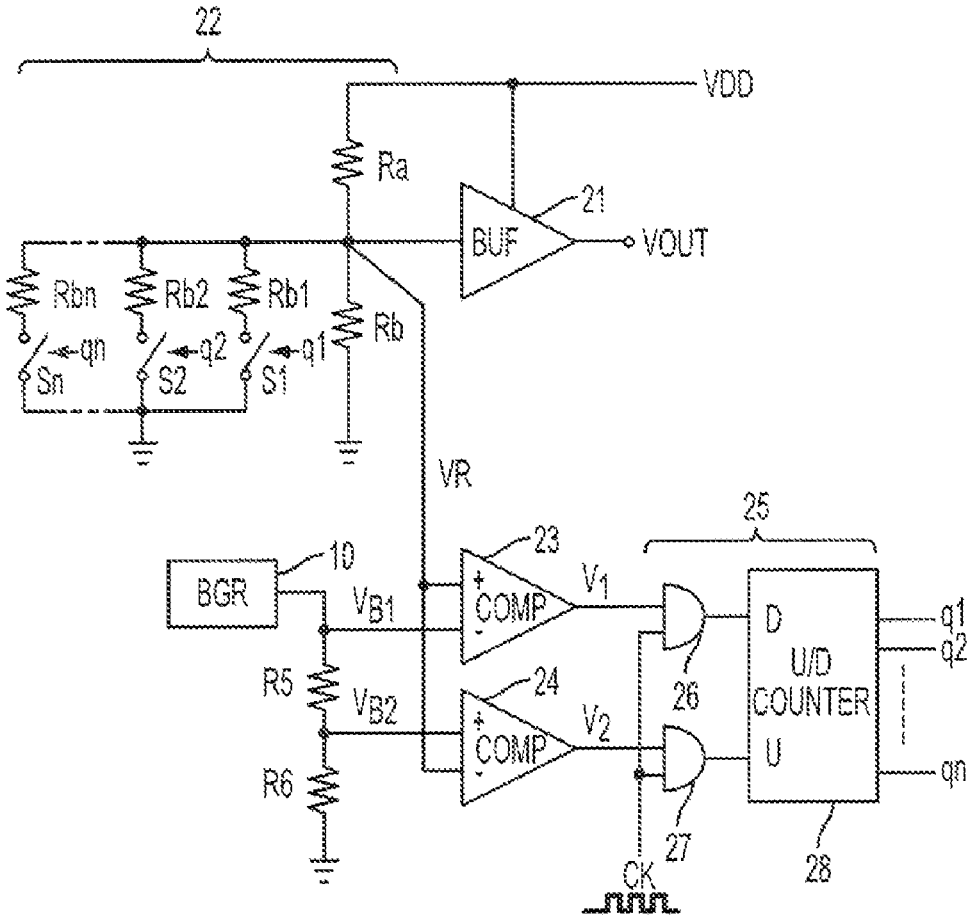
FIG. 4 is a diagram showing an example of a structure of a reference voltage generation circuit according to the present embodiment.

An embodiment according to the present invention will be described below with reference to the drawings. FIG. 4 is a diagram showing an example of a structure of a reference voltage generation circuit according to the present embodiment. As shown in FIG. 4, the reference voltage generation circuit according to the present embodiment includes a buffer amplifier 21 which is driven by a source voltage $V_{DD}$ and of which output voltage is produced as a reference voltage, a resistive element 22 for determining an input voltage of the buffer amplifier 21 by using the source voltage $V_{DD}$, a band gap regulator 10 to be driven by the source voltage $V_{DD}$, voltage division resistors R5 and R6, comparators 23 and 24, and a control circuit 25. These structures are integrated into a single semiconductor chip through a CMOS (Complementary Metal Oxide Semiconductor) process or a Bi-CMOS (Bipolar-CMOS) process, for example.

The resistive element 22 is constituted by voltage division resistors Ra and Rb of the source voltage $V_{DD}$ connected to an input side of the buffer amplifier 21, at least one resistor Rb1, Rb2, . . . , , Rbn (n is an integer of one or more) connected in parallel with the resistor Rb, and at least one switch S1, S2, . . . , Sn connected in series between each of the resistors Rb1, Rb2, . . . , Rbn and a ground.

When the switch Si (i is any of 1 to n) is turned ON, the resistor Rbi connected in series to the switch Si turned ON is connected in parallel with the resistor Rb so that a voltage division ratio of the source voltage $V_{DD}$ is changed. More specifically, the voltage division ratio is obtained as Ra:(Rb+Rbi). For example, by causing all of resistance values of the resistors Rb1, Rb2, . . . , Rbn to be different from each other and selectively turning ON any of the switches Si, it is possible to variously change the voltage division ratio.

The resistance values of the resistors Rb1, Rb2, . . . , Rbn may be equal to each other and the voltage division ratio may be variously changed through a change in the number of the switches to be turned ON. Thus, the voltage division ratio of the source voltage $V_{DD}$ is changed to cause an input voltage $V_R$ of the buffer amplifier 21 to be variable. How to change the input voltage $V_R$ of the buffer amplifier 21 will be described below.

Figure 1:
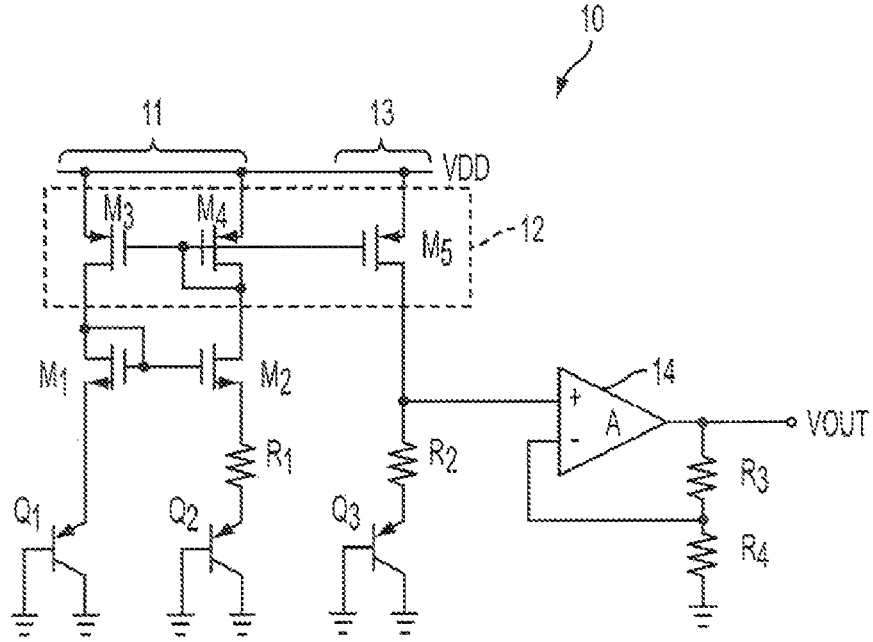
FIG. 1 PRIOR ART
FIG. 1 is a diagram showing a conventional reference voltage generation circuit.
Figure 2:
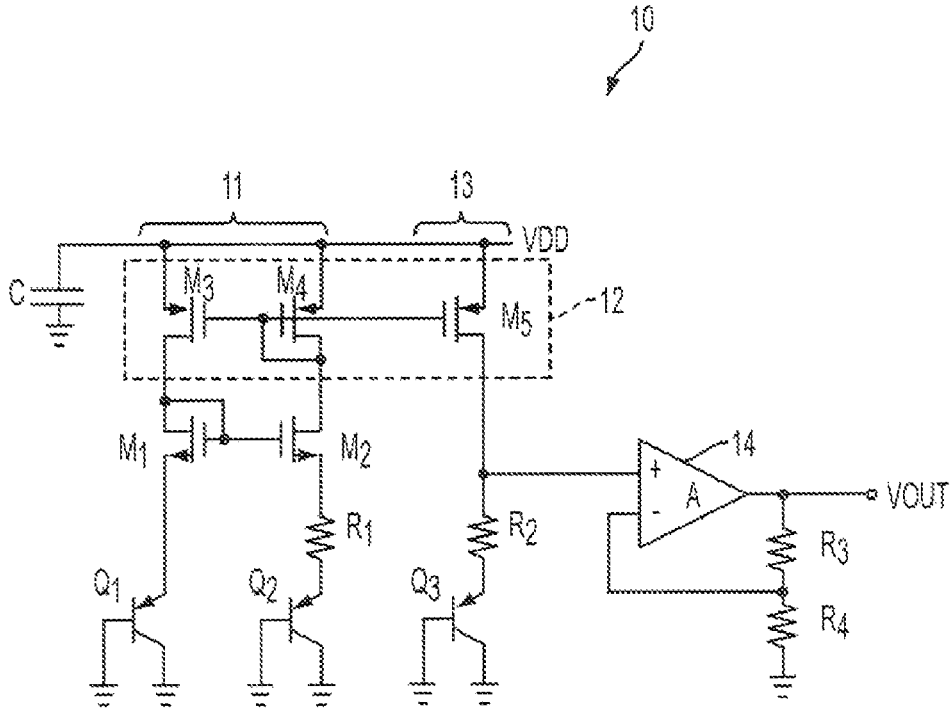
FIG. 2 PRIOR ART
FIG. 2 is a diagram showing an example of a structure to reduce a noise in the conventional reference voltage generation circuit.
Figure 3:
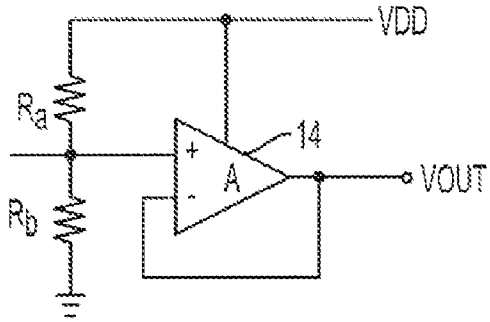
FIG. 3 PRIOR ART
FIG. 3 is a diagram showing another example of the structure of the reference voltage generation circuit to reduce the noise.

The band gap regulator 10 is constituted in the same manner as shown in FIG. 1, for example, and an almost stable output voltage can be obtained irrespective of a fluctuation in the source voltage $V_{DD}$. An operational amplifier may be connected to an output of the band gap regulator 10. The voltage division resistors R5 and R6 serve to divide an output voltage of the band gap regulator 10. The comparators 23 and 24 compare the input voltage V of the buffer amplifier 21 with the output voltage of the band gap regulator 10 and outputs a comparison signal.

Figure 5:
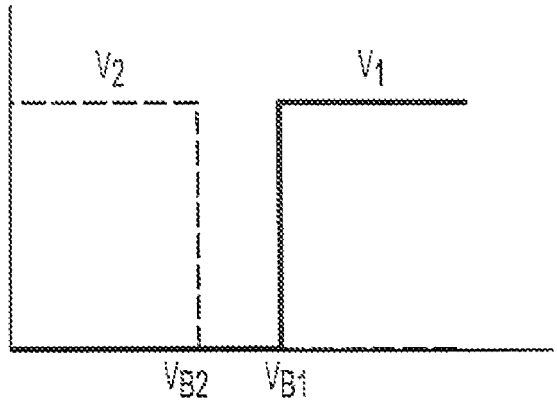
FIG. 5 is a chart showing an example of a comparison signal output from a comparator according to the present embodiment.

More specifically, the first comparator 23 sets a first output voltage $V_{B1}$ generated by the voltage division resistors R5 and R6 (for example, the output voltage of the band gap regulator 10 which has not been divided) as one of inputs (a comparison reference) and sets the input voltage $V_R$ of the buffer amplifier 21 as the other input, and compares values of these two inputs and outputs a first comparison signal $V_1$ corresponding to a result of the comparison. Consequently, the first comparison signal $V_1$ has a low level with $V_R<V_{B1}$ and has a high level with $V_R \geqq V_{B1}$ as shown in FIG. 5.

Moreover, the second comparator 24 sets a second output voltage $V_{B2}$ generated by the voltage division resistors R5 and R6 as one of inputs and sets the input voltage $V_R$ of the buffer amplifier 21 as the other input (a comparison reference), and compares values of these two inputs and outputs a second comparison signal $V_2$ corresponding to a result of the comparison. Consequently, the second comparison signal. $V_2$ has a high level with $V_R<V_{B2}$ and has a low level with $V_R \geqq V_{B2}$ as shown in FIG. 5.

The control circuit 25 turns ON any of the switches S3, S2, . . . , Sn in such a manner that the output voltage of the buffer amplifier 21 (the output voltage of the reference voltage generation circuit) gets into a desirable voltage range (a range of $V_{B2}$ to $V_{B1}$) in response to the two comparison signals $V_1$ and $V_2$ output from the comparators 23 and 24, thereby carrying out a variable control over the resistance value of the resistive element 22 on the input side of the buffer amplifier 21 (the voltage division ratio of the source voltage $V_{DD}$).

The control circuit 25 includes two AND gates 26 and 27 and an updown counter 28. The first AND gate 26 ANDs the first comparison signal $V_1$ output from the first comparator 23 and a clock signal CK for repeating a high level and a low level at a predetermined time interval and outputs a result to a down terminal D of the updown counter 28. Moreover, the second AND gate 27 ANDs the second comparison signal $V_2$ output from the second comparator 24 and the clock signal. CK and outputs a result to an up terminal U of the updown counter 28.

The updown counter 28 carries out count-up or countdown in response to a signal output from the first AND gate 26 based on the first comparison signal $V_1$ output from the first comparator 23 and a signal output from the second AND gate 27 based on the second comparison signal $V_2$ output from the second comparator 24. In other words, the updown counter 28 carries out down-count in a cycle of the clock signal CK when the first comparison signal $V_1$ has a high level. Moreover, the updown counter 28 carries out p-count in the cycle of the clock signal CK when the second comparison signal $V_2$ has a high level. Any of the switches S1, S2, . . . , Sn is turned ON based on the count value to variably control the resistance value of the resistive element 22.

More specifically, when the first comparison signal $V_1$ has the high level, that is, the value of the input voltage $V_R$ of the buffer amplifier 21 is equal to or greater than the value of the output voltage $V_{B1}$ of the band gap regulator 10 ($V_R \geqq V_{B1}$), the updown counter 28 carries out the down-count. Then, any of the switches Si is sequentially turned ON to select the resistor Rbi having a great resistance value in such a manner that the voltage division value of the source voltage $V_{DD}$ to be used as the input voltage $V_R$ of the buffer amplifier 21 (=(Rb+Rbi)/(Ra+Rb+Rbi)) is decreased corresponding to the count value.

On the other hand, when the second comparison signal $V_2$ has the high level, that is, the value of the input voltage $V_R$ of the buffer amplifier 21 is smaller than the value of the divided voltage $V_{B2}$ of the band gap regulator 10 ($V_R<V_{B2}$), the updown counter 28 carries out the up-count. Then, any of the switches Si is sequentially turned ON to select the resistor Rbi having a small resistance value in such a manner that the voltage division value of the source voltage $V_{DD}$ to be used as the input voltage $V_R$ of the buffer amplifier 21 (=(Rb+Rbi)/(Ra+Rb+Rbi)) is increased corresponding to the count value.

Thus, any of the switches S1, S2, . . . , Sn is sequentially switched and turned ON corresponding to the count value of the updown counter 28 so that the value of the input voltage $V_R$ of the buffer amplifier 21 is sequentially changed. Because an amplification factor of the buffer amplifier 21 is one, an output voltage $V_{out}$ of the buffer amplifier 21, that is, a reference voltage output from the reference voltage generation circuit is also changed in the same manner as the input voltage $V_R$ of the buffer amplifier 21.

Figure 6:
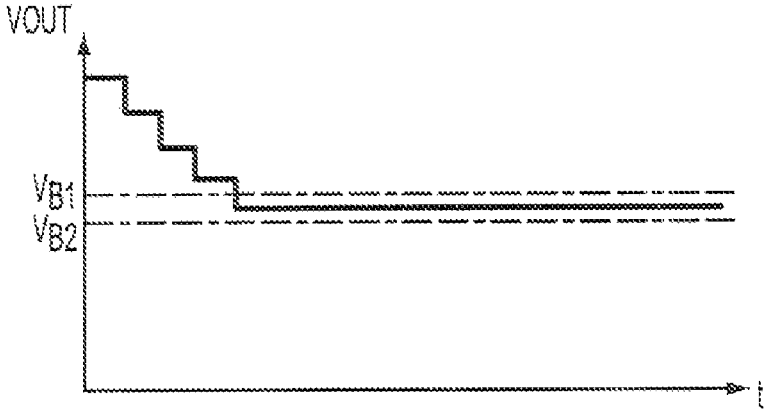
FIG. 6 is a chart showing an example of an operation of the reference voltage generation circuit according to the present embodiment.

FIG. 6 is a chart showing an example of an operation of the reference voltage generation circuit according to the present embodiment, illustrating a state of the reference voltage $V_{out}$ to be changed as described above. The example of FIG. 6 shows the case in which the input voltage $V_R$ of the buffer amplifier 21 (that is, the reference voltage $V_{out}$ output from the buffer amplifier 21) temporarily becomes higher than the output voltage $V_{B1}$ of the band gap regulator 10 due to a fluctuation in the source voltage $V)_{DD}$.

In this case, the updown counter 28 carries out the downcount and sequentially switches and turns ON the switches S1, S2, . . . , Sn corresponding to the count value so that the reference voltage $V_{out}$ is gradually decreased. When the input voltage $V_R$ of the buffer amplifier 21 is lower than the output voltage $V_{B1}$ of the band gap regulator 10, the counting operation of the updown counter 28 is stopped so that the switches S1, S2, . . . , Sn are also stopped to be changed over. Consequently, the reference voltage $V_{out}$ output from the buffer amplifier 21 is stabilized again in the range from $V_{B2}$ to $V_{B1}$.

As described above in detail, in the present embodiment, the basic structure of the reference voltage generation circuit is formed by the buffer amplifier 21 and the resistive element 22 for determining the input voltage $V_R$ of the buffer amplifier 21 without using the band gap regulator. Consequently, it is possible to eliminate a drawback that a noise made in the band gap regulator carries out wraparound into the circuit of the basic structure, resulting in a deterioration in S/N. Moreover, in the present embodiment, the buffer amplifier 21 having an amplification factor of one is used in place of an operational amplifier having an amplifying function. Therefore, it is also possible to reduce an output noise. Thus, it is possible to effectively reduce an influence of the noise without using a capacitor having a large capacity which inhibits an integration.

Furthermore, in the present embodiment, the band gap regulator 10, the voltage division resistors R5 and R6, the comparators 23 and 24 and the control circuit 25 are provided for the structure to stabilize the output voltage $V_{out}$ of the buffer amplifier 21. Consequently, even if the source voltage $V_{DD}$ fluctuates, the output voltage $V_{out}$ of the reference voltage generation circuit can be maintained to be almost constant within a desirable voltage range (the range from $V_{B2}$ to $V_{B1}$). Accordingly, it is possible to provide a reference voltage generation circuit in which an integration can easily be carried out, an influence of a noise is lessened, and a fluctuation in the output voltage $V_{out}$ is also lessened with a change in the source voltage $V_{DD}$.

In order to further reduce the influence of the noise, it is also possible to increase a distance between the basic structures 21 and 22 of the reference voltage generation circuit and the band gap regulator 10 on a chip layout. Moreover, a guard ring may be provided between the basic structures 21 and 22 and the band gap regulator 10.

It is possible to further reduce a noise of the buffer amplifier 21 by increasing a value of W/L, wherein a channel width and a channel length in an input transistor of the buffer amplifier 21 are represented by W and L, respectively. For example, by decreasing the channel length L of the input transistor, it is possible to reduce a thermal noise of the buffer amplifier 21. In this case, a flicker noise made in a low frequency region is increased. Accordingly, it is preferable that the channel width W and the channel length L in the input transistor should also be set to have great values and W>>L should be set to increase the value of W/L.

Although the description has been given to the example in which the input voltage V of the buffer amplifier 21 is set to be one of the inputs in each of the comparators 23 and 24 in the embodiment, the present invention is not restricted thereto. As described above, the buffer amplifier 21 has the amplification factor of one and the input voltage $V_R$=the output voltage $V_{out}$ in the buffer amplifier 21 is set. Therefore, the output voltage $V_{out}$ of the buffer amplifier 21 may be given to one of the inputs in each of the comparators 23 and 24.

Figure 7:
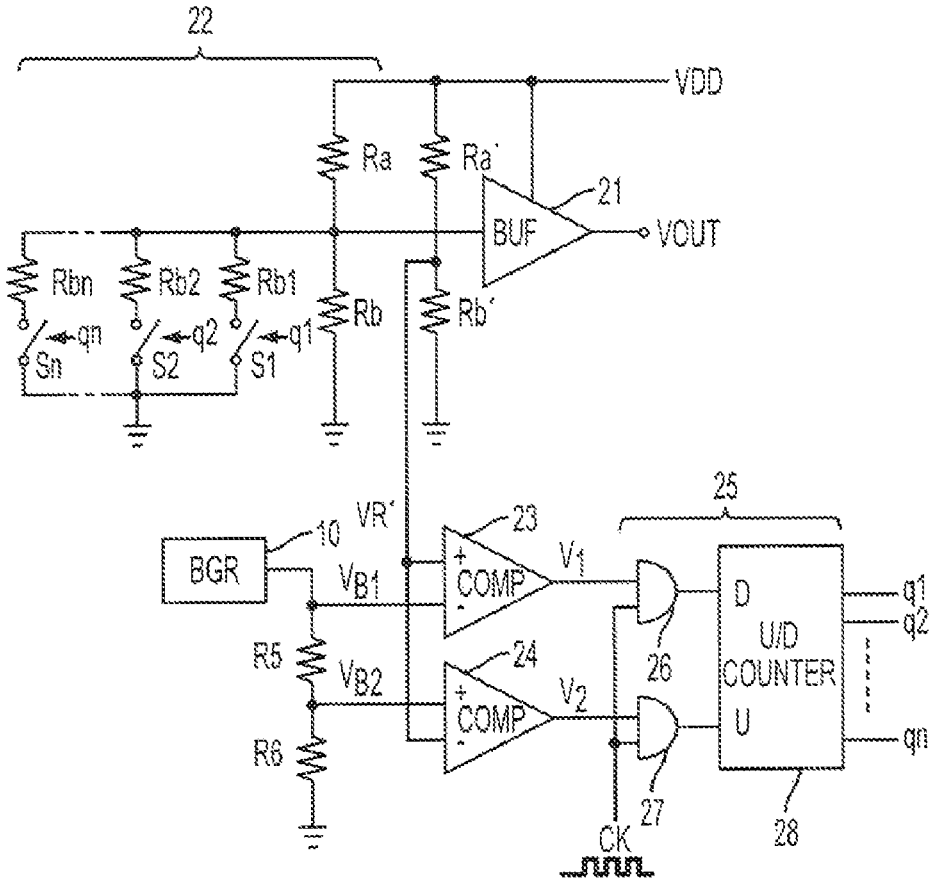
FIG. 7 is a diagram showing another example of the structure of the reference voltage generation circuit according to the present embodiment.

As shown in FIG. 7, dummy voltage division resistors Ra' and Rb' imitating the voltage division resistors Ra and Rb of the resistive element 22 (which correspond to the dummy resistive element in the present invention) may be provided and voltages generated by the dummy voltage division resistors Ra' and Rb' may be given to one of the inputs in each of the comparators 23 and 24. For example, resistance values of the dummy voltage division resistors Ra' and Rb' are set to obtain Ra/Rb=Ra'/Rb'. By such a structure, a possibility of an oscillation can be lessened as compared with the example shown in FIG. 4 in which the input voltage $V_R$ itself of the buffer amplifier 21 is monitored and is thus controlled variably.

Although the description has been given to the example of the resistive element 22 in which the resistors are used in the embodiment, the present invention is not restricted thereto. In other words, it is also possible to use any element capable of causing the resistance value to be variable other than the resistor. Moreover, the structure for causing the resistance value to be variable is not restricted to the structure shown in FIG. 4. For example, it is also possible to cause a combined resistance value of at least one resistor to be variable by connecting a plurality of resistors and a plurality of switches like a ladder and selecting any of the switches. In this case, the resistance values of the resistors may be different from each other or may be equal to each other.

Figure 8:
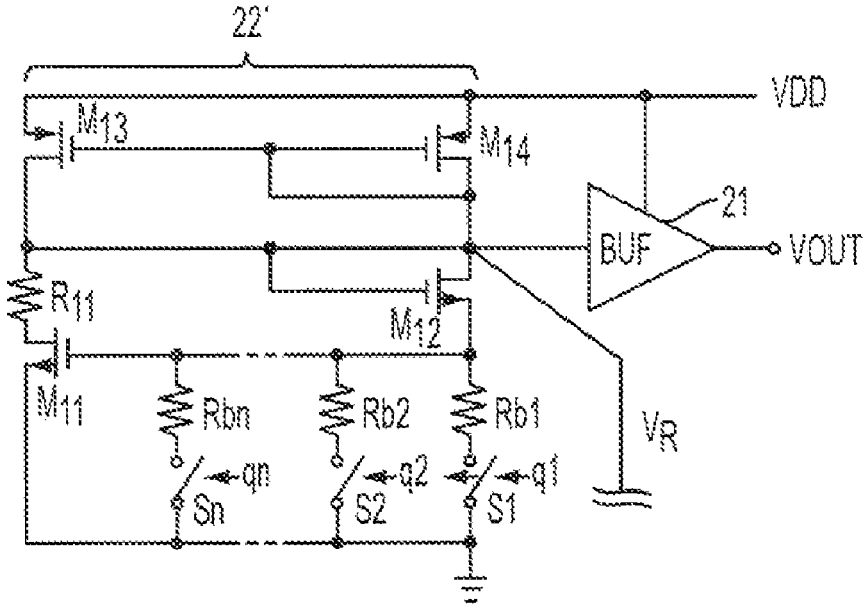
FIG. 8 is a diagram showing a further example of the structure of the reference voltage generation circuit according to the present embodiment.

FIG. 8 is a diagram showing a resistive element 22' according to a further example of the structure. In FIG. 8, components having the same functions as the components shown in FIG. 4 have the same reference numerals. The resistive element 22' shown in FIG. 8 includes at least one resistor Rb1, Rb2, . . . , Rbn and at least one switch S1, S2, . . . , Sn which are constituted in the same manner as in FIG. 4, Nch transistors M11 and M12, and Pch transistors M13 and M14.

The Nch transistor M11 has a source connected to a ground, has a gate connected to a common node of the resistors Rb1, Rb2, . . . , Rbn and has a drain connected to a drain of the Pch transistor M13 through a resistor R11. The Nch transistor M12 has a source connected to the common node of the resistors Rb1, Rb2, . . . , Rbn, has a gate which is diode connected to its own drain, and has the drain connected to a drain of the Pch transistor M14.

A gate of the Pch transistor M14 is diode connected to its own drain and is connected to a gate of the Pch transistor M13. The Pch transistors M13 and M14 have sources connected to a power supply $V_{DD}$. An input terminal of a buffer amplifier 21 is connected between the drain of the Nch transistor M12 and that of the Pch transistor M14. Moreover, an input voltage $V_R$ of the buffer amplifier 21 is produced.

A divided voltage determined by turning ON any of the switches S1, S2, . . . , Sn is amplified by the Nch transistor M11 and is input to the buffer amplifier 21. At this time, a switching noise made on the source side of the Nch transistor M12 (a common node side of the resistors Rb1, Rb2, . . . , Rbn) is changed into a signal having a phase inverted by the Nch transistor M11 and is fed back to the Nch transistor M12 in a state in which the phase is inverted. Consequently, it is possible to effectively suppress a ripple occurring in the input voltage $V_R$ of the buffer amplifier 21 through a variable control of a resistance value using the switches S1, S2, . . . , Sn.

Figure 9:
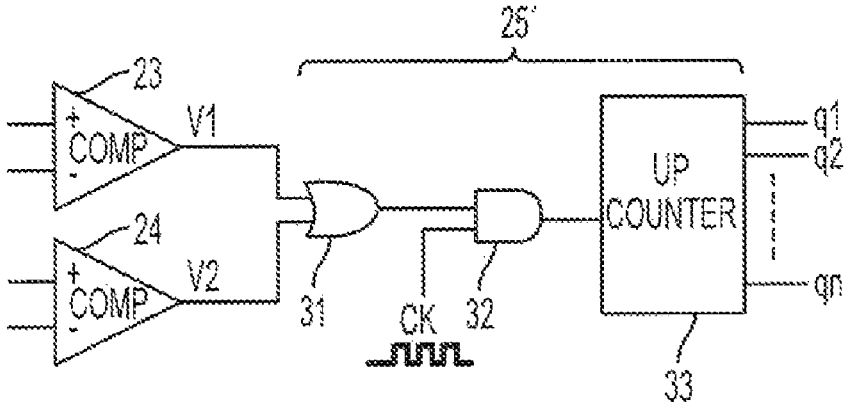
FIG. 9 is a diagram showing another example of a structure of a counter to be used in the reference voltage generation circuit according to the present embodiment.

Although the updown counter 28 is used in the embodiment, the present invention is not restricted thereto. For example, as shown in FIG. 9, it is also possible to use a counter 33 for carrying out only count-up or count-down. FIG. 9 is a diagram showing a control circuit 25' according to another example of the structure which includes the counter 33. In the same manner as the control circuit 25, the control circuit 25' variably controls the resistance value of the resistive element 22 by turning ON any of the switches S1, S2, . . . , Sn in such a manner that the output voltage of the buffer amplifier 21 gets into a desirable voltage range in response to two comparison signals $V_1$ and $V_2$ output from the comparators 23 and 24.

The control circuit 25' shown in FIG. 9 includes an OR gate 31, an AND gate 32, and the up counter 33. The OR gate 31 ORs the first comparison signal $V_1$ output from the first comparator 23 and the second comparison signal $V_2$ output from the second comparator 24, and outputs a result to the AND gate 32. The AND gate 32 ANDs a signal output from the first OR gate 31 and a clock signal CK repeating a high level and a low level at a predetermined time interval and outputs a result to a clock terminal of the up counter 33.

The up counter 33 carries out count-up in response to a signal output from the AND gate 32 based on the first comparison signal $V_1$ output from the first comparator 23 and the second comparison signal $V_2$ output from the second comparator 24. In other words, the up counter 33 carries out up-count in a cycle of the clock signal CK when at least one of the first comparison signal $V_1$ and the second comparison signal $V_2$ has a high level.

When carrying out counting up to a maximum value of the counter, the up counter 33 returns to a zero value and then performs the count-up. Then, the up counter 33 variably controls the resistance value of the resistive element 22 by turning ON any of the switches S1, S2, . . . , Sn based on the count value.

Thus, any of the switches S1, S2, . . . , Sn is sequentially switched and turned ON corresponding to the count value of the up counter 33 so that the value of the input voltage $V_R$ of the buffer amplifier 21, and furthermore, the output voltage $V_{out}$ of the buffer amplifier 21 are sequentially changed. Although the up counter 33 is used in FIG. 9, a down counter may be used.

In addition, all of the embodiments are only illustrative for a concreteness to carry out the present invention and the technical range of the present invention should not be thereby construed to be restrictive. In other words, the present invention can be carried out in various forms without departing from the spirit or main features thereof.

INDUSTRIAL APPLICABILITY

The present invention is useful for a reference voltage generation circuit for generating a reference voltage to be widely utilized in various analog circuits.

This application is based on Japanese Patent Application No. 2006-331391 filed on Dec. 8, 2006, the contents of which are incorporated hereinto by reference.

The invention claimed is:

1. A reference voltage generation circuit comprising:

a buffer amplifier which is driven by a source voltage and of which output voltage is produced as a reference voltage;

a resistive element for determining an input voltage of the buffer amplifier by using the source voltage;

a band gap regulator to be driven by the source voltage;

a comparator for comparing the input voltage of the buffer amplifier with an output voltage of the band gap regulator and outputting a comparison signal; and a control circuit for variably controlling a resistance value of the resistive element in such a manner that the output voltage of the buffer amplifier gets into a desirable voltage range in response to the comparison signal output from the comparator.

2. The reference voltage generation circuit according to claim 1, wherein the comparator inputs the output voltage of the buffer amplifier in place of the input voltage of the buffer amplifier and compares the output voltage of the buffer amplifier with the output voltage of the band gap regulator, and outputs a comparison signal.

3. The reference voltage generation circuit according to claim 1, further comprising a dummy resistive element imitating the resistive element, wherein the comparator inputs a voltage generated by the dummy resistive element in place of the input voltage of the buffer amplifier and compares the voltage generated by the dummy resistive element with the output voltage of the band gap regulator, and outputting a comparison signal.

4. The reference voltage generation circuit according to claim 1, further comprising a voltage division resistor for dividing the output voltage of the band gap regulator the comparator including a first comparator for setting, as one of inputs, a first output voltage generated by the voltage division resistor and a second comparator for setting, as one of inputs, a second output voltage generated by the voltage division resistor, and the control circuit including a counter for carrying out count-up or count-down in response to a first comparison signal output from the first comparator and a second comparison signal output from the second comparator and variably controlling the resistance value of the resistive element based on an output value of the counter.

5. The reference voltage generation circuit according to claim 2, further comprising a voltage division resistor for dividing the output voltage of the band gap regulator the comparator including a first comparator for setting, as one of inputs, a first output voltage generated by the voltage division resistor and a second comparator for setting, as one of inputs, a second output voltage generated by the voltage division resistor, and the control circuit including a counter for carrying out count-up or count-down in response to a first comparison signal output from the first comparator and a second comparison signal output from the second comparator and variably controlling the resistance value of the resistive element based on an output value of the counter.

6. The reference voltage generation circuit according to claim 3, further comprising a voltage division resistor for dividing the output voltage of the band gap regulator the comparator including a first comparator for setting, as one of inputs, a first output voltage generated by the voltage division resistor and a second comparator for setting, as one of inputs, a second output voltage generated by the voltage division resistor, and the control circuit including a counter for carrying out count-up or count-down in response to a first comparison signal output from the first comparator and a second comparison signal output from the second comparator and variably controlling the resistance value of the resistive element based on an output value of the counter.

* * * * *